US006138879A

United States Patent [19]

Breuner

[11] Patent Number: 6,138,879

[45] **Date of Patent: *Oct. 31, 2000**

[54] MALLET TOOL AND METHOD FOR CREATING PROPER POCKET FORMATION IN ATHLETIC BALL CATCHING GLOVES

[75] Inventor: Richard Breuner, Truckee, Calif.

[73] Assignee: Truckee Winter Sports, Inc., Truckee, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 09/137,639

[22] Filed: Aug. 20, 1998

[51] Int. Cl.[7] ..... A63B 67/00

[52] U.S. Cl. ..... 223/78; 273/25

[58] Field of Search ..... 223/78, 79, 80, 223/1; 273/25

[56] References Cited

U.S. PATENT DOCUMENTS

| | | | |
|---|---|---|---|
| 3,169,019 | 2/1965 | Genjack | 273/276 |
| 5,421,493 | 6/1995 | Ebeling, II . | |
| 5,492,321 | 2/1996 | Cipriano . | |
| 5,547,114 | 8/1996 | Mitchell . | |
| 5,638,999 | 6/1997 | Greene | 223/78 |

*Primary Examiner*—Bibhu Mohanty
*Attorney, Agent, or Firm*—Burns, Doane, Swecker & Mathis LLP

[57] ABSTRACT

In order to simulate the true action of a sports ball in breaking in a sports glove, a mallet tool is provide with a spherical head designed to replicate the size, feel and appearance of a regulation sports ball. A handle is rigidly attached to the spherical head and is grasped by the operator in one hand while the sports glove is worn in the other. By holding and repeatedly striking the mallet tool into the glove's pocket area repeatedly, the creation and maintenance of a pocket in the glove is facilitated. The mallet head and handle may be formed as an integral piece either molded, cast or machined from a blank, but in the preferred embodiment includes a mallet head that is an genuine regulation sports ball (baseball, softball or other) attached either mechanically or with glue to a handle resembling a miniature or youth baseball bat handle.

22 Claims, 2 Drawing Sheets

MALLET TOOL AND METHOD FOR CREATING PROPER POCKET FORMATION IN ATHLETIC BALL CATCHING GLOVES

BACKGROUND OF THE INVENTION

1. Field of the Invention

The invention relates to a method and apparatus used for the break-in of athletic equipment, and specifically, to ball catching gloves.

2. Description of Related Art

It is recognized that baseball and softball glove performance improves with use of the glove, which use transforms the glove material into more pliant form and enables it to better match the shape of the ball. This transformation improves the wearer's ability to retain a grip on the ball and thereby improves the player's overall performance. Prior art devices have sought to expedite the break-in procedure using a variety of approaches.

While the device in U.S. Pat. No. 5,421,493 to Ebeling is a mallet type tool designed to break in and maintain new and used softball and baseball gloves, it does not include a mallet head that is a genuine regulation sports ball (baseball, softball or other) or replica used for critical glove pocket formation.

The device of U.S. Pat. No. 5,492,321 to Cipriano is designed to assist players in their batting practice and is not designed for handling by the player's gloves. It fails to address the concerns of the instant invention.

The device of U.S. Pat. No. 5,547,114 to Mitchell, in addition to being cumbersome and costly, is also beset with the same shortcomings as the Ebeling patent. It similarly does not teach the features of the applicant's invention.

Although there are numerous theories and techniques on the subject of breaking in a baseball glove, there is no single agreed upon method other than that playing catch is almost always included with any method.

SUMMARY OF THE INVENTION

The present invention overcomes the deficiencies of the prior art by providing a mallet tool which replicates most closely the most effective method of breaking in a glove, which is playing catch with a partner. An advantage of the invention is that the same effect of playing catch can be achieved without requiring a partner. The mallet tool also achieves the effects of playing catch in the most efficient way possible by allowing the user to focus the force of a ball into the pocket portion of the glove over and over again, creating critical pocket formation. The method used includes grasping the mallet handle with the throwing hand and striking the mallet's head repeatedly into the pocket area of the glove worn on the other hand.

The invention provides a mallet tool designed to facilitate the task of breaking in a new athletic ball catching glove as well as maintain its pocket and performance during typically long periods of non-use during the off season. The mallet tool uses a head which effectively replicates the size, feel and appearance of a genuine regulation sports ball, along with an attached handle preferably in the style and dimension of the handle of a youth baseball bat. These features allow the user to simulate the effects of the single greatest activity toward the proper break in of a new glove—i.e., playing catch—as well as maintaining its pocket and performance during typically long periods of non-use during the off season. Advantages of the arrangement in accordance with the invention include well defined connection region between the head and the handle, allowing for a greater range of impact angles with which the mallet tool can be struck against the glove. This in effect increases the number of effective impacts during repeated strikes. Further, in accordance with one embodiment, the handle of the mallet tool is styled after baseball bat handle including the knob end to prevent the mallet tool from slipping from the user's hand during use.

BRIEF DESCRIPTION OF THE DRAWINGS

Many advantages of the present invention will be apparent to those skilled in the art with a reading of this specification in conjunction with the attached drawings, wherein like reference numerals are applied to like elements and wherein:

FIG. 2 is a schematic representation of a second attachment scheme in accordance with the invention.

DESCRIPTION OF THE PREFERRED EMBODIMENTS

Figure 1:
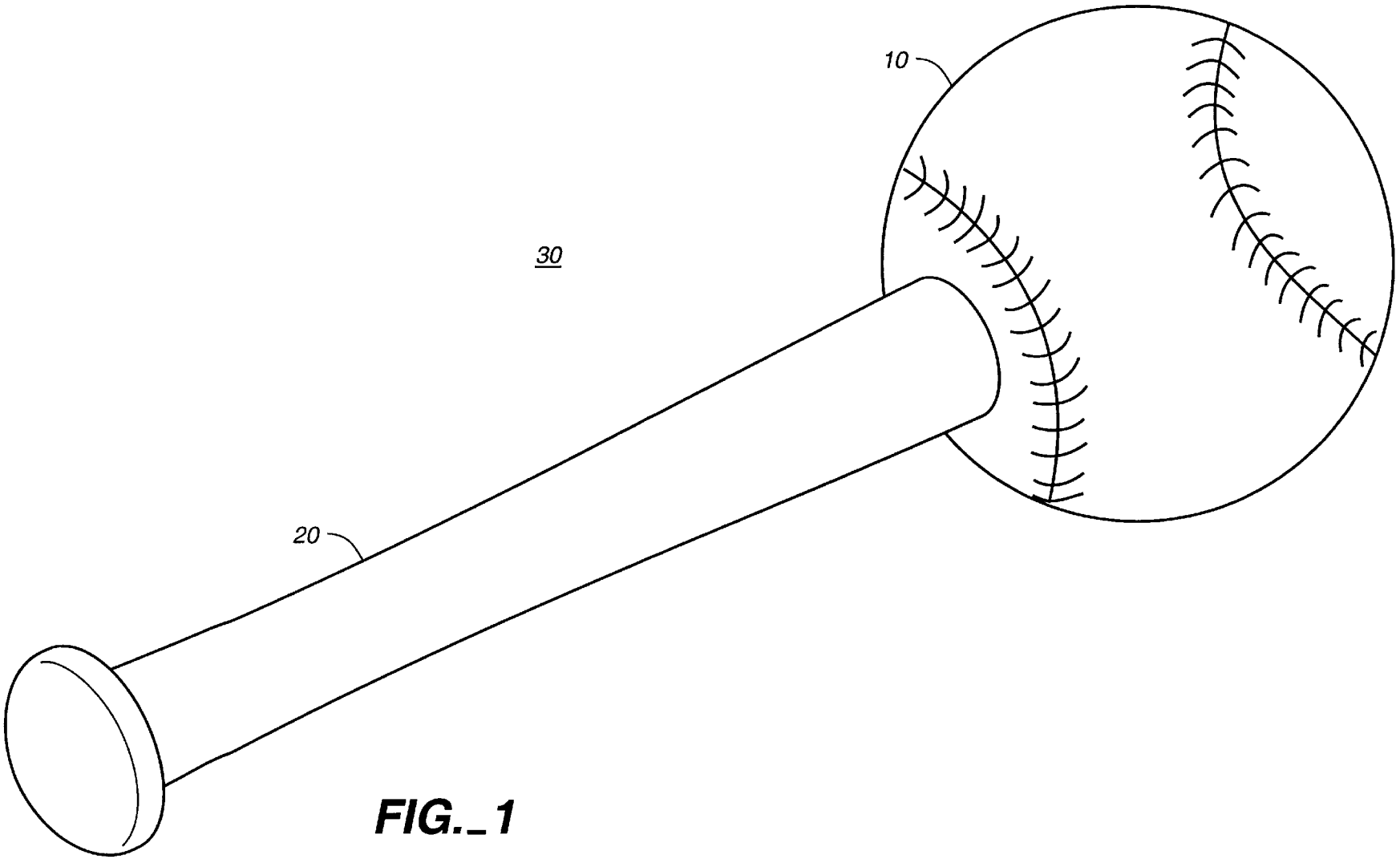
FIG. 1 is a schematic representation of a mallet tool in accordance with an embodiment of the invention.

FIG. 1 shows a mallet tool 30 in accordance with the invention. Mallet tool 30 comprises a head 10 preferably comprising a genuine regulation sports ball. The head 10 is fitted with a handle 20 to facilitate handling of the head during beating of the head into the pocket area of an athletic ball catching glove (not shown) to create and maintain a pocket of the glove.

It is important that the head 10 replicate the look and feel of a genuine sports ball and in the preferred embodiment an actual regulation ball is used as the head. The ball can for instance be either a regulation baseball or a regulation softball, depending on the application.

Alternatively, a head configured to resemble a regulation ball can be used. For instance, where a softball application is contemplated, a spherically shaped head having a 4-inch diameter can be used, whereas for a baseball application a spherically shaped head having a 3-inch diameter can be used.

The handle 20 is preferably cylindrical, with a diameter of ½ inch to 1½ inches except for the knob end 30 which is also cylindrical but is enlarged to a diameter of 1½ inches to 2 inches. The length of the handle, including the knob end, is in the range of 6 inches to 12 inches from where the handle meets the head.

The handle 20, like similar handles on a hammer, mallet, ax, etc., provides a moment arm whereby when the operator grasps the handle with his throwing hand, there is developed a significant force when the head strikes the glove's pocket area, with a substantial amount of momentum being transferred into the pocket area of the glove. To achieve this moment arm, the length of the handle 20 is selected to be at least 6 inches but not more than 14 inches. A handle of less than 6 inches in length will not achieve enough momentum in the head 10 to appreciably facilitate pocket formation, while a handle of longer than 14 inches is longer than is necessary to generate the momentum required for effective pocket formation and renders the apparatus awkward in handling.

The handle of the mallet tool 20 may be made of any relatively rigid material including, but not limited to, wood, metal, plastic or fiber glass. As discussed above, the head 10 is preferably a genuine regulation sports ball adapted to be connected to the handle, but could also be a replica of a genuine regulation sports ball made of any material with a non-abrasive finish including, but not limited to, wood, metal, rubber or plastic. The mallet tool may also be fabricated as a single unit using any of the aforementioned materials. An important feature of the invention is that the head replicate the size, feel and appearance of a genuine regulation sports ball, such as a baseball or softball, in order to more faithfully reproduce the break-in conditions to which the glove should ideally be subject.

Figure 2:
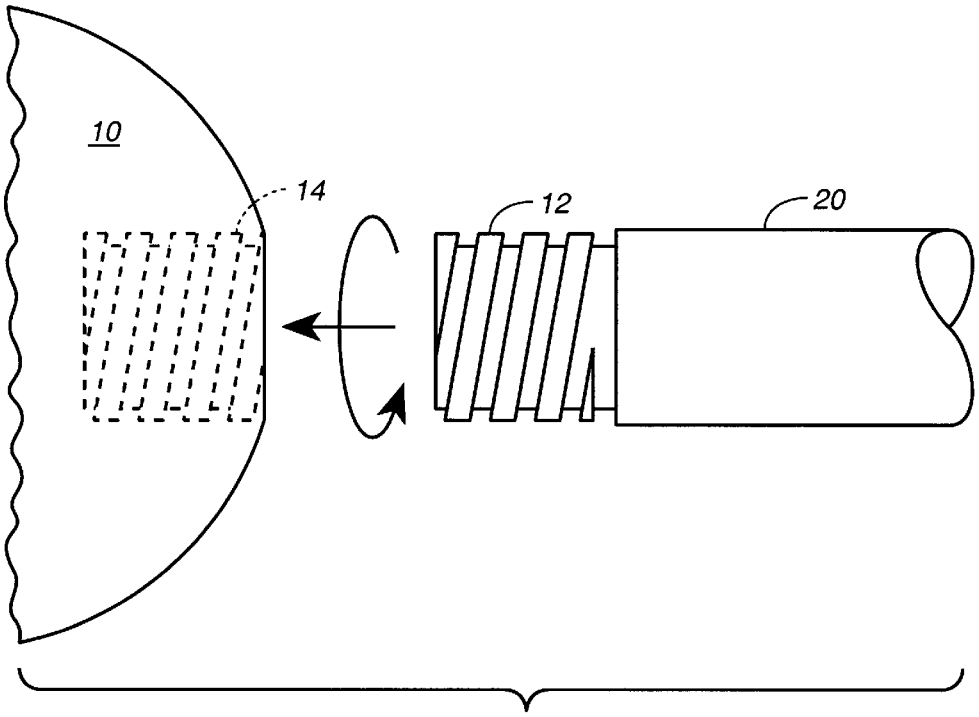
FIG. 2 is a schematic representation of a first attachment scheme in accordance with the invention.
Figure 3:
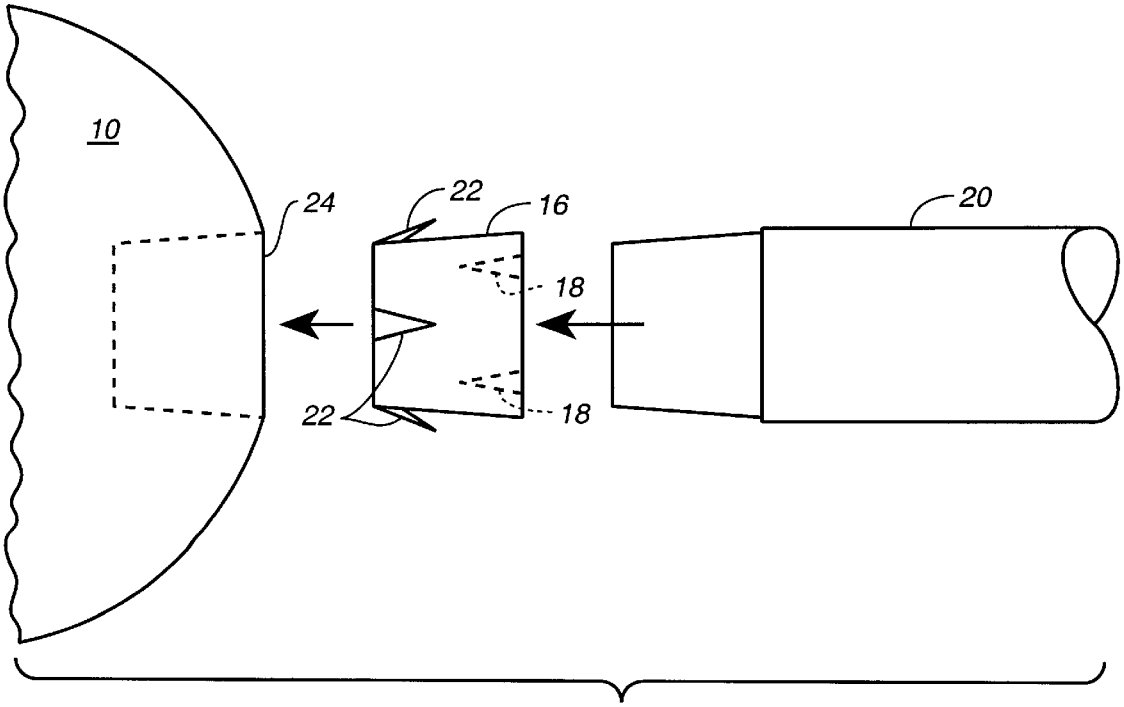

The handle 20 may be formed by casting or molding, or it may be machined from a blank. The head 10 is preferably a genuine regulation sports ball, or it may be a replica formed by casting, molding, or machined from a blank. Similarly, if fabricated as a single unit, the mallet tool 30 may be formed by casting, molding, or machined from a blank. If formed separately, the head 10 and handle 20 are adapted to be connected mechanically or with adhesive. Contemplated methods of attachment include but are not limited to a threaded mating arrangement, such as the exemplary arrangement shown in FIG. 2, wherein a threaded male portion 12 of the handle 20 mates with threaded female portion 14 formed in head 10. Alternatively, a sleeve arrangement can be used, illustrated schematically in FIG. 3, whereby the handle 20 is fitted into a sleeve 16 having inwardly directed claws 18 which penetrate the material of the handle 20 and outwardly facing claws 22 penetrating a pre-drilled hole 24 in the head 10. Other contemplated methods of attachment include friction fitting the two components and or using an adhesive.

It should be noted that the arrangement in accordance with the invention provides a distinct dividing line between the handle 20 and the head 10, permitting better simulation of the performance of a fully rounded ball impacting the glove and affording a greater range of impact angles of the mallet tool 30 into the pocket of the glove. An advantage of such a configuration is the increased number of effective impacts since the impacts during repeated beating are not all identical.

In use, mallet tool handle 20 is grasped in one hand hand and the glove to be treated is worn on the other hand. The operator then beats head 10 of mallet tool 30 into the pocket area of the glove, repeatedly and as necessary, to create and maintain desired pocket formation.

The above are exemplary modes of carrying out the invention and are not intended to be limiting. It will be apparent to those skilled in the art that modifications thereto can be made without departure from the spirit and scope of the invention as set forth in the following claims.

What is claimed is:

1. A mallet tool for breaking in a sports glove used for catching a sports ball, the mallet tool comprising:

a spherical head corresponding in size and shape to said sports ball; and a handle rigidly attached to the spherical head such that a longitudinal axis of the handle passes through the center of the spherical head, said handle comprising a unitary piece of rigid, inflexible material having a grasping end for grasping by the hand of an operator and a mounting end for mounting to the spherical head such that the spherical head is immovable relative to the grasping end of the handle.

2. The mallet tool of claim 1, wherein the spherical head comprises a regulation sports ball.

3. The mallet tool of claim 2, wherein the regulation sports ball comprises a regulation baseball.

4. The mallet tool of claim 2, wherein the regulation sports ball comprises a regulation softball.

5. The mallet tool of claim 1, wherein the diameter of the spherical head is about 3 inches.

6. The mallet tool of claim 1, wherein the diameter of the spherical head is about 4 inches.

7. The mallet tool of claim 1, wherein the handle threadingly mates with the spherical head.

8. The mallet tool of claim 1, further comprising a sleeve for receiving a portion of the handle therein, the sleeve adapted to fit into the spherical head.

9. The mallet tool of claim 8, wherein the sleeve is provided with at least one set of one or more claws adapted to maintain the relative position of the sleeve.

10. The mallet tool of claim 1, wherein the spherical head and the handle are integrally formed.

11. The mallet tool of claim 1, wherein the handle is attached to the spherical head using adhesive.

12. The mallet tool of claim 1, wherein the handle is friction fitted into the spherical head.

13. A method for manually breaking in a sports glove for catching a sports ball, the method comprising:

wearing the sports glove on one hand;

beating the sports glove with a mallet tool held in a different hand, the mallet tool comprising:

a spherical head corresponding in size and shape to said sports ball;

a handle rigidly attached to the spherical head such that a longitudinal axis of the handle passes through the center of the spherical head, said handle comprising a unitary piece of rigid, inflexible material having a grasping end for grasping by the hand of an operator and a mounting end for mounting to the spherical head such that the spherical head is immovable relative to the grasping end of the handle.

14. The method of claim 13, wherein the spherical head comprises a regulation sports ball.

15. The method tool of claim 14, wherein the regulation sports ball comprises a regulation baseball.

16. The method of claim 14, wherein the regulation sports ball comprises a regulation softball.

17. The method of claim 13, wherein the diameter of the spherical head is about 3 inches.

18. The method of claim 13, wherein the diameter of the spherical head is about 4 inches.

19. The method of claim 13, wherein the handle threadingly mates with the spherical head.

20. The method of claim 13, further comprising a sleeve for receiving a portion of the handle therein, the sleeve adapted to fit into the spherical head.

21. The method of claim 13, wherein the handle is friction fitted into the spherical head.

22. The method of claim 13, wherein the spherical head and the handle are integrally formed.

* * * * *